US006730006B1

(12) United States Patent
Patterson

(10) Patent No.: US 6,730,006 B1
(45) Date of Patent: May 4, 2004

(54) BACK PAIN/BACK HEALTH PROTOCOL

(76) Inventor: Paul Patterson, 87 Ch. Pic Bois, Val Des Monts, Quebec (CA), J8N 6C4

( * ) Notice: Subject to any disclaimer, the term of this patent is extended or adjusted under 35 U.S.C. 154(b) by 0 days.

(21) Appl. No.: 09/927,039

(22) Filed: Aug. 9, 2001

Related U.S. Application Data

(60) Provisional application No. 60/224,066, filed on Aug. 9, 2000.

(51) Int. Cl.[7] ..... A63B 71/00

(52) U.S. Cl. ..... 482/148; 482/907; 482/91; 482/139; 128/32; 128/33; 128/897; 128/869; 128/882; 602/24; 606/240

(58) Field of Search ..... 482/148, 907, 482/91, 131, 121, 124, 126, 128, 93, 909, 139; 128/897–898, 882, 869, 32, 33; 602/24; 606/240

(56) References Cited

U.S. PATENT DOCUMENTS 5,180,386 A * 1/1993 Kennedy ..... 606/240
5,954,056 A * 9/1999 Eckman ..... 128/898
6,179,756 B1 * 1/2001 Bertolucci ..... 482/91

* cited by examiner

*Primary Examiner*—Nicholas D. Lucchesi
*Assistant Examiner*—L Amerson
(74) *Attorney, Agent, or Firm*—Conley Rose, P.C.

(57) ABSTRACT

An integrated back pain and back health program incorporating proper posture to achieve joint realignment and muscle relaxation, proper breathing to achieve stress management and muscle relaxation, and an exercise program focused on the muscles of the back, neck, shoulders, abdomen and hips to achieve muscle and joint flexibility and strengthening. By providing instruction on maintaining proper posture, the protocol offers back pain sufferers relief from the stress caused by muscles involuntarily attempting to realign and/or stabilize misaligned joints. The breathing techniques used in the protocol aid in muscle relaxation and, together with proper posture, maximize the benefits of the exercises performed in the procedure. The exercises in the protocol stretch and strengthen the muscles that are commonly implicated in the occurrence of back pain, release spasm in those muscles, and reset those muscles to normal tonus.

24 Claims, 17 Drawing Sheets

BACK PAIN/BACK HEALTH PROTOCOL

CROSS-REFERENCE TO RELATED APPLICATIONS

This application claims priority based on provisional patent application Ser. No. 60/224,066, filed Aug. 9, 2000.

FIELD OF THE INVENTION

The invention relates to a method for relieving back pain and improving back health. More particularly, the invention relates to a back pain and back health protocol selectively incorporating various exercise protocols designed to promote proper posture and breathing and to stretch and strengthen the muscles of the back, neck, shoulders, abdomen, and hips.

BACKGROUND OF THE INVENTION

Back pain is a problem for a significant number of people. Numerous causes can lead to pain in the back. One common source of back pain is the normal human preference for using muscles on one side of the body. A right-handed person, for example, tends to use the right hand, arm, and leg more often than the left, leading to increased muscle strength on the dominant side. This can create a bilateral strength imbalance and cause bilateral misalignment of the spine. Anterior/posterior strength imbalance and misalignment of the spine and other joints can either be caused by or result in poor posture. When the neck, shoulders, back, and/or hips are subjected to bilateral or anterior/posterior misalignment, chronic muscle contraction or muscle spasm can occur in an involuntary attempt to prevent further misalignment. A lack of exercise can also lead to weakness, low flexibility, and spasms in the muscles of the back, neck, shoulders, abdomen, and hips. In addition, stress can contribute to back problems. In stressful situations a 'fight-or-flight' response sometimes occurs leading to involuntary contraction of muscles and misalignment of joints in order to prepare for fighting or fleeing. If unrelieved, these muscle contractions and joint misalignments can eventually lead to muscle spasms and back pain. The prevalence of back problems can thus be attributed to any one of, or any combination of, bilateral dominance, poor posture, inactivity, and the skeleto-neuro-muscular response to mismanaged stress.

Traditional treatments for back pain do not adequately address the causes of back pain and/or do not provide the back pain sufferer with a long-term plan for improving and maintaining back health and preventing back pain. Physical therapy tends to be symptom-based. It has the capability to offer temporary relief from excessive muscle contraction (i.e., muscle spasm) but typically does not offer the back pain sufferer instruction in the exercise protocols, posture models, breathing methods, and stress management techniques that can provide long-term relief from back pain. Chiropractic therapy has the capability to realign joints but, as is the case with physical therapy, clients are typically not taught proper posture, proper breathing techniques, or proper exercise habits. Without adequate education, clients of both physical therapy and chiropractic therapy tend to return to the habits that caused their back problems. Analgesic and muscle relaxant drug therapies can provide temporary relief from back pain but do not address the causes of the pain.

The present invention offers an improvement over traditional back pain prevention and treatment protocols by addressing the causes of back pain such as stress, poor posture, and poor muscle tone and by providing the back pain sufferer with the education needed to carry out a long-term program for improving back health and preventing future back pain.

SUMMARY OF THE INVENTION

The present invention, hereafter generally referred to as the Back Pain/Back Health Protocol, relates to an integrated back pain relief and strengthening program comprising: joint realignment and muscle relaxation through proper posture; stress management and muscle relaxation through proper breathing; and muscle stretching and strengthening through an exercise program focused on the muscles of the back, neck, shoulders, abdomen, and hips. By providing instruction on maintaining proper posture, the Back Pain/Back Health Protocol offers back pain sufferers relief from the stress caused by muscles involuntarily contracting and spasming in an attempt to realign and/or stabilize misaligned joints. The breathing techniques used in the Back Pain/Back Health Protocol aid in muscle relaxation and, together with proper posture, maximize the benefits of the exercises performed in the procedure. The exercises in the Back Pain/Back Health Protocol are designed to stretch and strengthen the muscles that are commonly implicated in the occurrence of back pain. The combination of proper posture, proper breathing, and muscle stretching and strengthening exercises prevents the occurrence of back pain and provides back pain sufferers a unique and effective means of attaining long-term relief from back pain.

DESCRIPTION OF THE DRAWINGS

The invention, together with further advantages thereof, can be more fully understood by reference to the following drawings in which.

DETAILED DESCRIPTION

Figure 1:
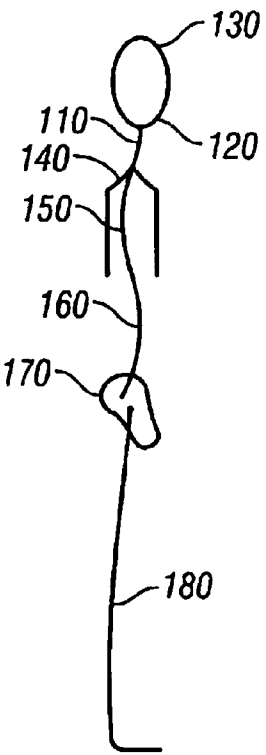
FIG. 1 is a schematic of the alpha posture.

The present invention, hereafter referred to as the Back Pain/Back Health Protocol, relates to a method for preventing and relieving back pain through the use of a combination of proper posture, a breathing protocol, and a set of exercise protocols for increasing strength and flexibility in the muscles of the back, neck, shoulders, abdomen, and hips. The preferred posture used in the Back Pain/Back Health Protocol is known as the 'alpha posture', an anatomically optimal, gravity-neutral position in which the joints are aligned properly. As shown in FIG. 1, in the alpha posture the neck 110 is straight and extended upward, the chin 120 is tucked in slightly, the head 130 is directly above a line connecting the shoulders 140, the shoulders 140 are depressed toward the floor and retracted toward the back of the body to align at right angles to the sides of the head 130, the thoracic 150 and lumbar 160 portions of the spine are extended upward so that anatomically optimal curvatures are maintained, the pelvis 170 is rotated to the rear of the body so that the proper interface with the sacroiliac joints is maintained, and the knees 180 are locked. The alpha posture promotes proper alignment of joints and thus prevents the muscular contractions or spasms that may occur involuntarily to realign and/or stabilize misaligned joints.

Figure 2A:
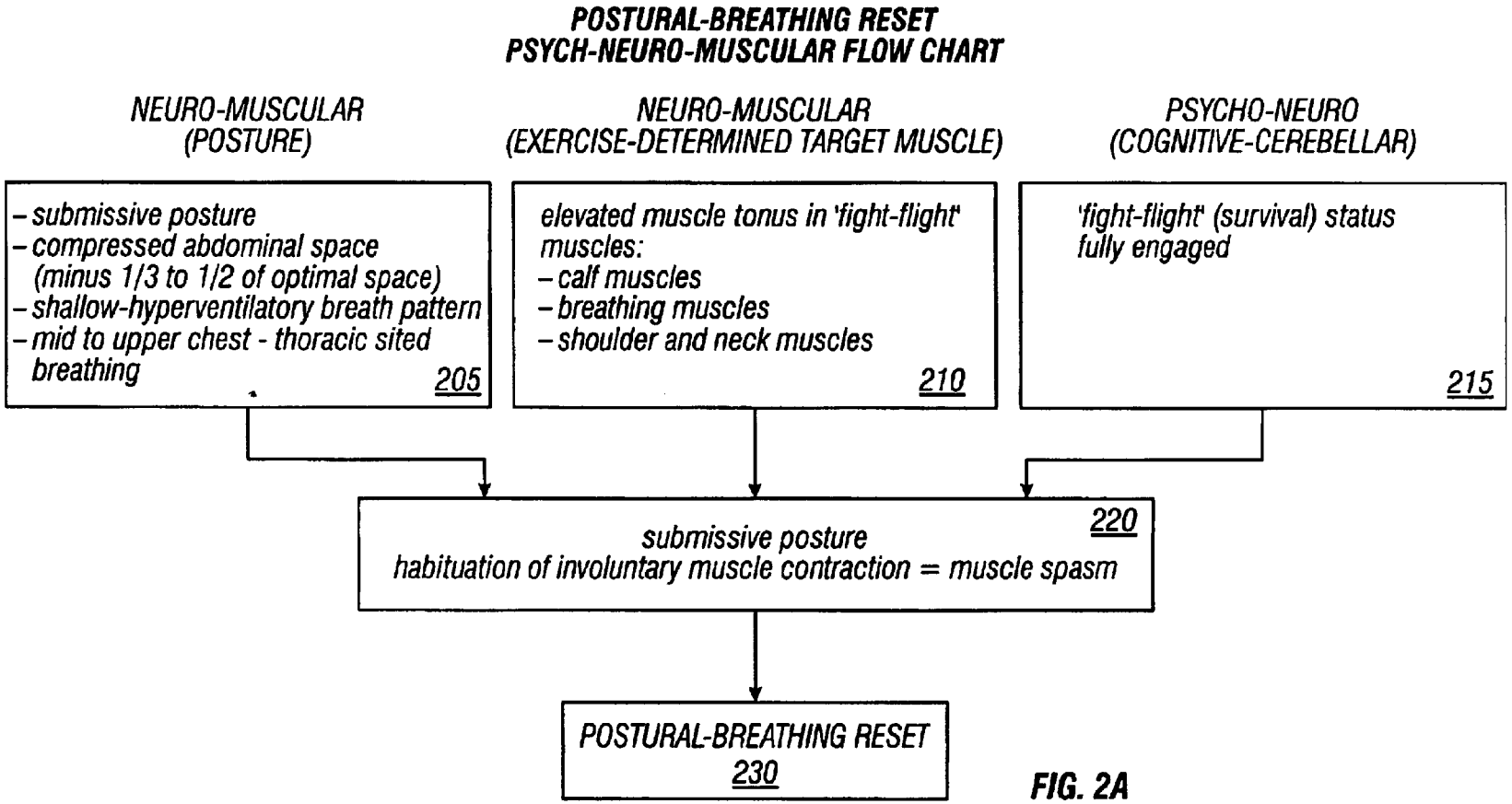
FIGS. 2A and 2B are a flow chart depicting the elements of the breathing reset protocol.
Figure 2B:
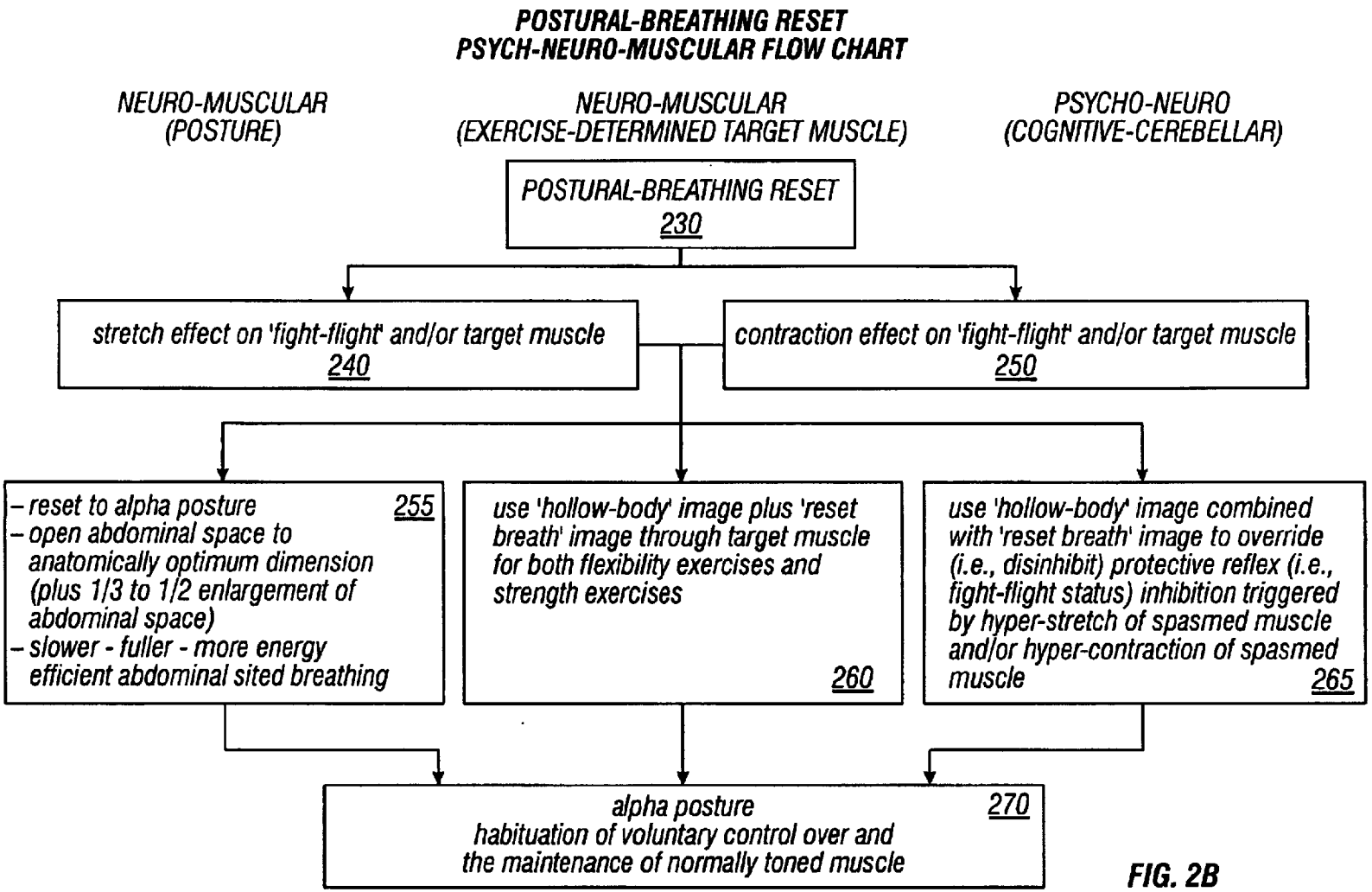

The breathing technique used in the Back Pain/Back Health Protocol is known as the breathing reset method. One of the goals of breathing reset is to aid the exerciser in eliminating a submissive, non-alpha posture and attaining the alpha posture. FIGS. 2A and 2B are a flow chart depicting the rationale, procedures, and effects of the breathing reset method as applied to the transformation from the submissive to the alpha posture. Boxes 205, 210, and 215 in FIG. 2A describe the neuro-muscular and psycho-neural elements of the submissive posture. As shown in box 205, the postural, neuro-muscular effects of assuming a submissive posture are a compressed abdominal space, a shallow hyperventilatory breathing pattern, and breathing focused on the middle to upper chest and thoracic area. Box 210 describes the neuro-muscular effects of a submissive posture on target muscles. In a submissive posture, a 'fight-or-flight' state of readiness is assumed resulting in contraction of the calf, shoulder, and neck muscles and the muscles used in breathing. As box 215 shows, the 'fight-or-flight' status involves a psycho-neural as well as a neuro-muscular response. The neuro-muscular and psycho-neural elements of the submissive posture can result in habitual, involuntary muscle contraction, or muscle spasm, as shown in box 220. The breathing reset method, box 230, can eliminate the negative effects of a submissive posture and allow the exerciser to attain and maintain alpha posture.

In the continuation of the breathing reset method flowchart in FIG. 2B, breathing reset, box 230, is initiated with stretching, box 240, and/or contraction, box 250, as needed to return spasmed muscles to their normal status. The neuro-muscular and psycho-neural effects of the breathing reset method are shown in Figures 255, 260, and 265. The postural, neuro-muscular results, box 255, are an opening of the abdominal space to an optimum dimension and a slower, fuller, more energy-efficient, abdomen-based breathing. Box 260 describes the breathing reset method as applied to target muscles, as described more fully below. Box 265 describes the psycho-neural image used in the breathing reset method. As shown in Figure 270, the alpha posture and its related neuro-muscular and psycho-neural elements enable the exerciser to regain voluntary control over muscles and aid in maintenance of normal muscle tone.

In a preferred mode of performing breathing reset, the alpha posture as described above is generally assumed as a first step. The alpha posture maximizes the volume of the abdominal space and encourages the use of abdominal-based rather than thoracic-based breathing. That is, inhalation and exhalation are achieved predominantly through expansion and contraction of the abdomen rather than the rib cage. Ventilation is optimized and less energy is expended per breath in abdominal-based breathing as opposed to thoracic-based breathing. The user of the breathing reset method next forms a mental image in which the body is hollow except for a target muscle-joint complex. Upon exhalation of a physical breath, using abdominal-based breathing, the user imagines an internal breath passing from the top of the head, through the target muscle-joint complex, and then out of the body through the arms or legs, as indicated in box 260. When stretching exercises are performed without the breathing reset method, a significant pain response is elicited early in the range of motion at which point the exerciser's survival reflex is triggered, the breath is stopped and held, and any further stretch is heavily inhibited. The mental image used in the breathing reset method accentuates muscle stretching and relaxes muscle spasms by overriding the instinctive, protective inhibition against muscle stretching, particularly stretching of muscle which is in spasm (i.e., involuntarily contracted). Box 265 references this release of the protective reflex. When the breathing reset method is focused on the muscle joint complex targeted by an exercise, maximal relaxation, strengthening, and stretching of muscles can be achieved in the performance of the exercise.

Figure 3:
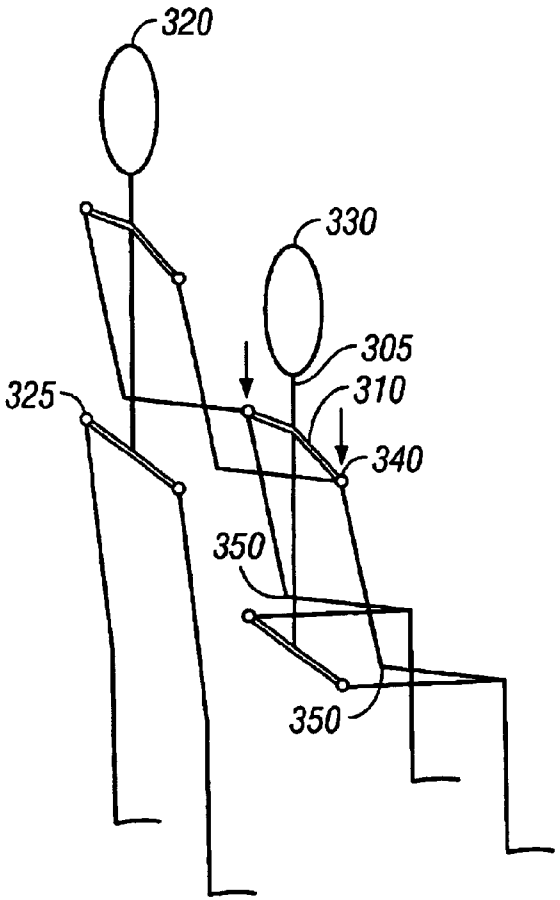
FIG. 3 is a schematic of a variation of the breathing reset protocol.

In a variation of the breathing reset method, shown in FIG. 3, the neck 305 and shoulder 310 areas are taken as the target muscle-joint complex and a partner 320 assists in achieving relaxation of the target area by depressing the shoulders 310 of the user 330. The partner 320 stands behind the user 330, if the user 330 is seated in a chair, or kneels behind the user 330 if the user 330 is seated on the floor. In either case, the waist 325 of the partner 320 is near the level of the shoulders 310 of the user 330. As the user 330 performs the breathing reset method described above, the partner 320 places his or her hands 340 on the shoulders 310 of the user 330 and exerts a slight downward pressure. In another variation of the breathing reset method the user 330 can, in addition to the steps just described, imagine depressing the elbows 350 or the fingers into the ground. Both of these variations serve as aids in achieving maximal relaxation and depression of the shoulders 310 thereby releasing muscle spasm and returning the target musclejoint complex to its normal tonal and anatomical status.

In combination with the alpha posture, the breathing reset method promotes the relaxation of muscles that may be involuntarily contracted due to mismanaged stress and/or improper joint alignment. The combination of alpha posture and the breathing reset method also enhances the effects of the exercises described below. In each of the exercises, a specific musclejoint complex is stretched and/or contracted. When the breathing reset method is used during the performance of an exercise, the muscle-joint complex that is the focus of the exercise becomes the target muscle-joint complex of the breathing method. The overlaying of the breathing reset method on the exercises below allows a significantly higher degree of stretching and muscle spasm release/ muscle tonus reset than the traditional method of performing the exercises alone could provide.

There are seven basic exercise protocols in the Back Pain/Back Health Protocol, four primarily intended to increase flexibility and three primarily intended to increase muscle strength. Variations exist for several of the exercise protocols. The overall goal of the strength and flexibility exercises is to relieve muscle spasms by resetting the muscles to their normal contraction (i.e., muscle tonus) status. It is preferable that the four stretching protocols be done as a group and that the three strength protocols be done as a group rather than selecting only certain stretching and certain strength exercises. This ensures that the upper/lower body core and posterior, anterior, and lateral body core and musculature are cumulatively targeted by a minimum number of exercises. The exercise protocols can be done in any sequence.

A typical sequence for performing one of the exercise protocols is to reach the point of maximum stretching during the exhalation phase of the breathing reset technique. While maintaining this position, two to three normal, involuntary breaths are taken. Another breath using the reset technique is then taken followed by two to three normal breaths. This sequence of a reset breath and two to three normal breaths, sometimes called 'monitoring breaths', is typically repeated two to four times for each exercise. Each reset breath will typically allow a greater extent of stretching to be attained and a ratcheting effect typically occurs whereby further stretching occurs with each sequence. The breathing reset method allows this greater degree of stretching by enabling an overriding of the instinctive, protective reflex encountered when stretching to full anatomic potential range of motion. As the user gains skill in the exercise protocol, the number of times the sequence of a reset breath and two to three monitoring breaths is repeated until maximum stretching is achieved typically decreases. Thus, a beginner may take three to four sequences to achieve maximum benefits, while an expert may require only one or two sequences.

Benefits for the protocols are also optimized when the alpha posture is maintained throughout the exercise protocols. However, some exercises require a position, such as a bending of the knees, that is not an element of the standing alpha posture. In these cases, it is preferable that all other elements of the alpha posture, as applied to the body core, be maintained to the extent possible.

Figure 4B:
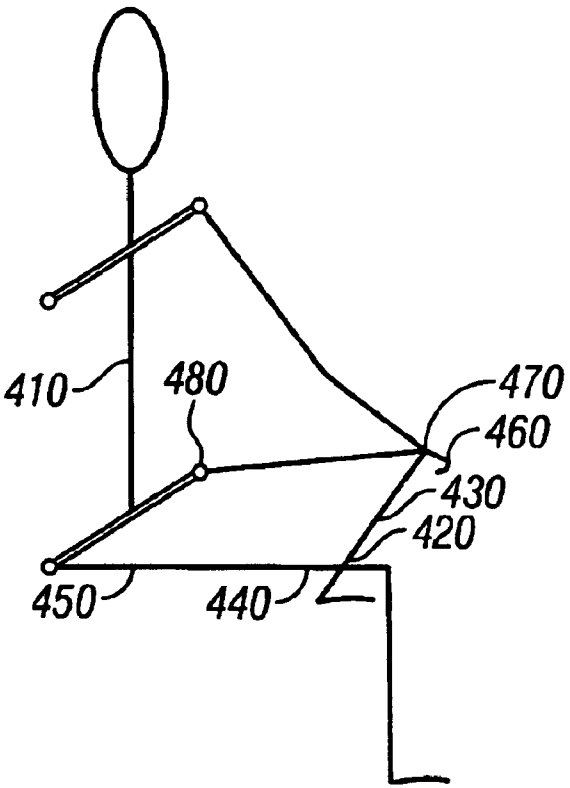
FIGS. 4A and 4B are schematics of an external hip rotation exercise protocol.
Figure 4A:
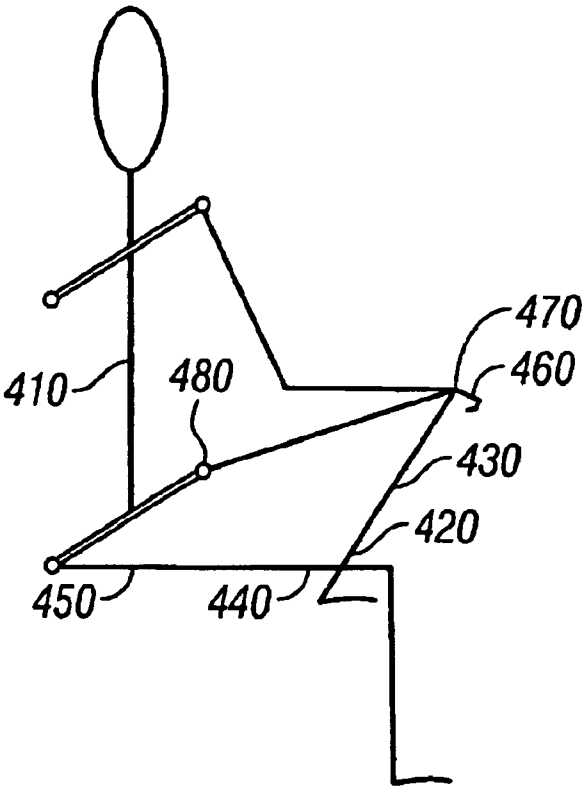
Figure 5B:
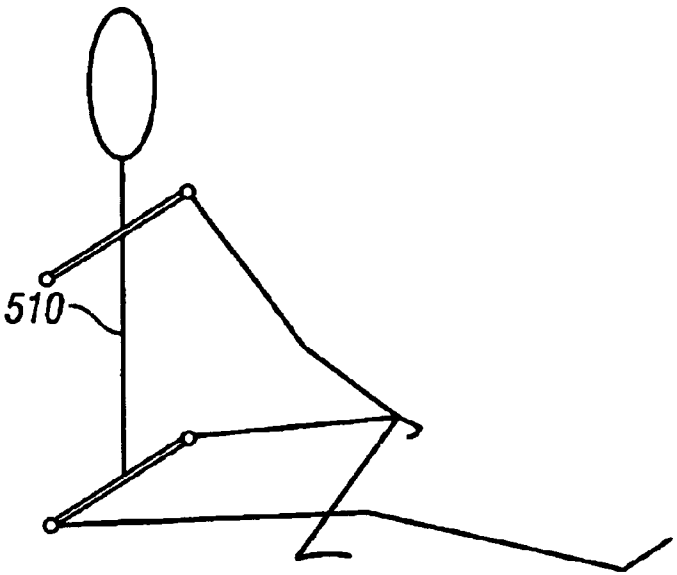
FIGS. 5A and 5B are schematics of a variation of the external hip rotation exercise protocol.
Figure 5A:
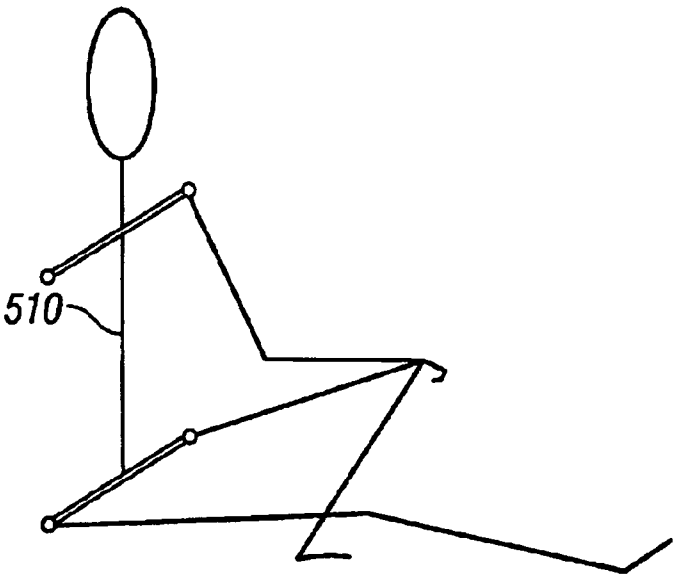
Figure 6B:
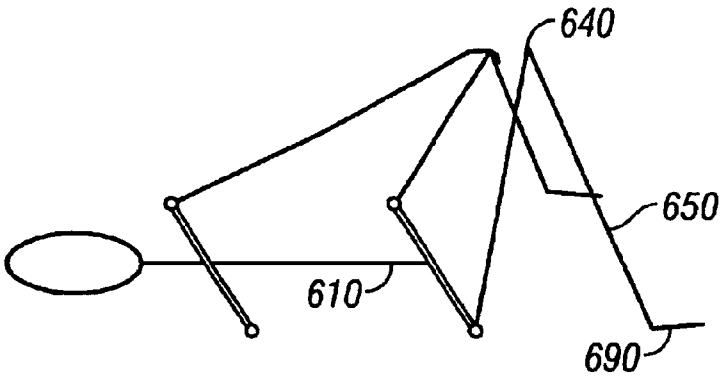
FIGS. 6A and 6B are schematics of another variation of the external hip rotation exercise protocol.
Figure 6A:
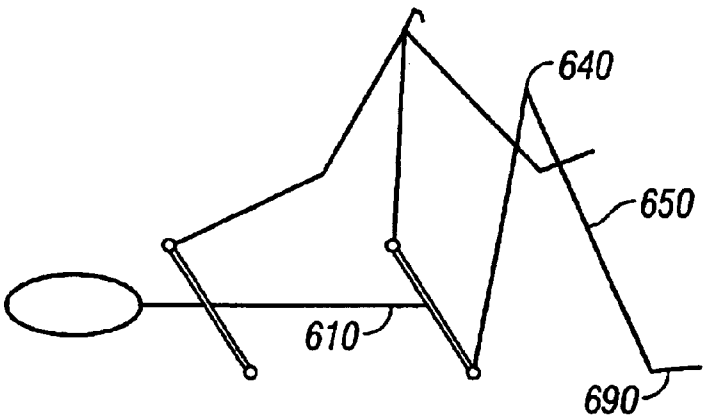

One of the flexibility exercises in the Back Pain/Back Health Protocol, the external hip rotation protocol, is illustrated in FIGS. 4A and 4B. As shown in FIG. 4A, the exerciser 410 sits on a chair or other support platform and places the outer portion of the ankle 420 of one leg 430 (the target leg) on the upper portion of the knee 440 of the other leg 450 (the support leg) and exerts downward pressure on the target leg 430 with the hand 460 that is on the same side of the body as the target leg 430. The knee 470 of the target leg 430 is pressed toward the floor as far as possible, as shown in FIG. 4B. The external hip rotation exercise stretches the internal rotator muscles of the target hip 480. In variations of this exercise, the exerciser 5 10 can be seated on the floor as illustrated in FIGS. 5A and 5B or the exerciser 610 can lie supine on the floor as illustrated in FIGS. 6A and 6B. If the exercise is done in a supine position, the knee 640 of the support leg 650 is bent so that the sole of the foot 690 of the support leg 650 is flat on the floor.

Figure 7B:
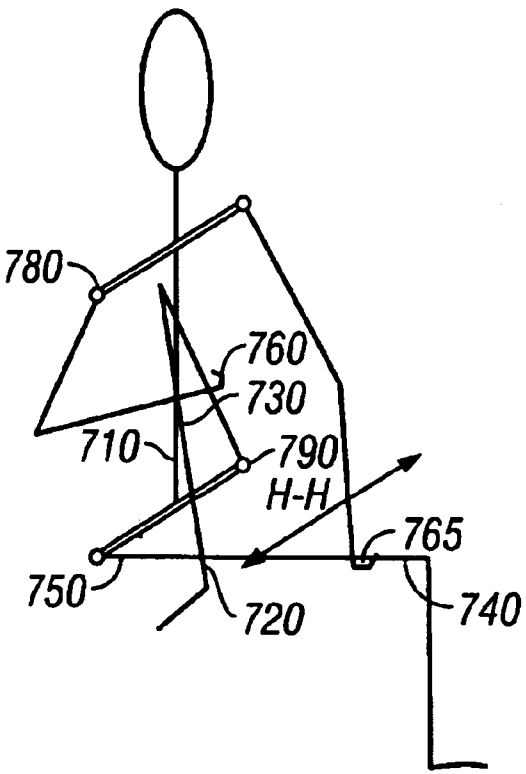
FIGS. 7A and 7B are schematics of an internal hip rotation exercise protocol.
Figure 7A:
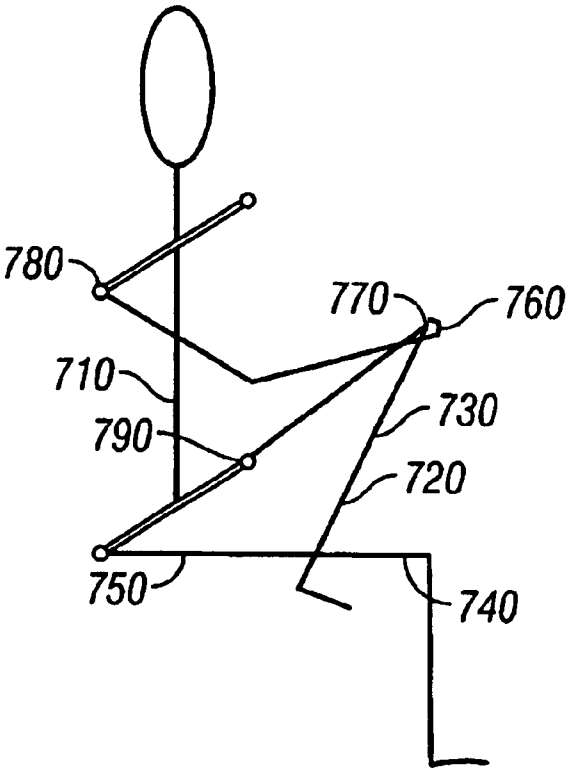
Figure 8B:
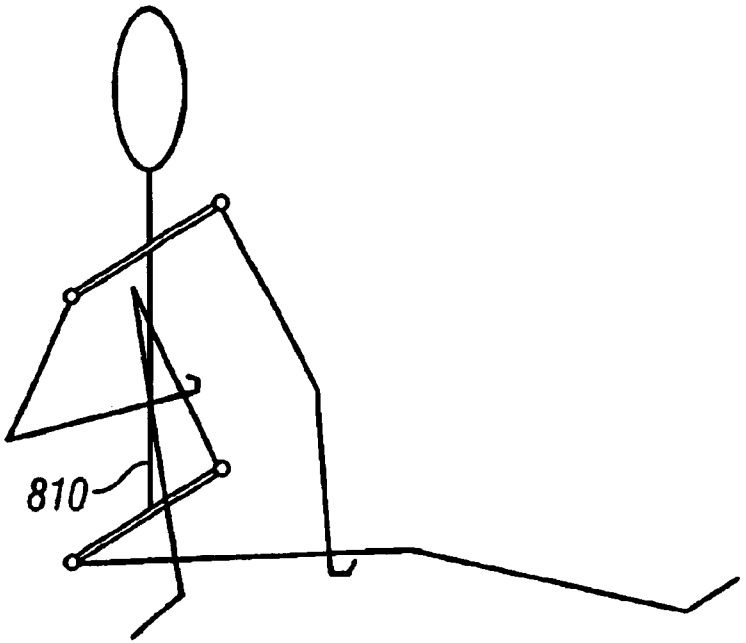
FIGS. 8A and 8B are schematics of a variation of the internal hip rotation exercise protocol.
Figure 8A:
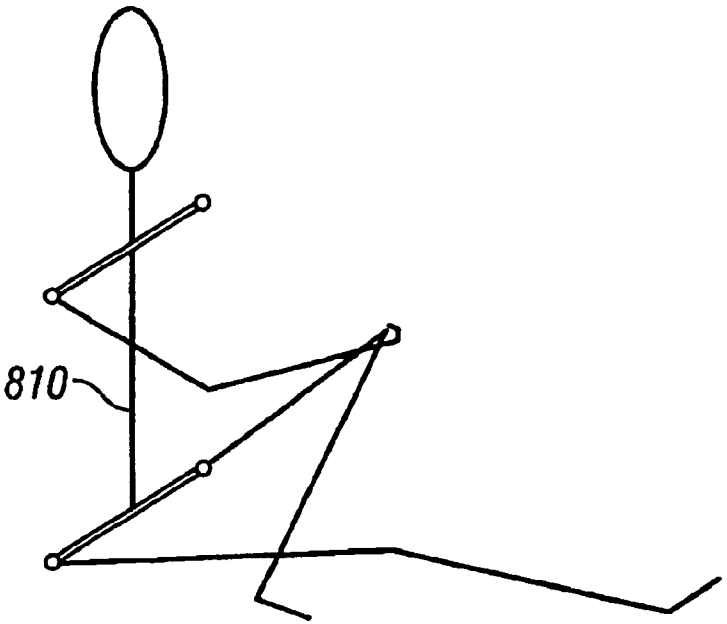
Figure 9B:
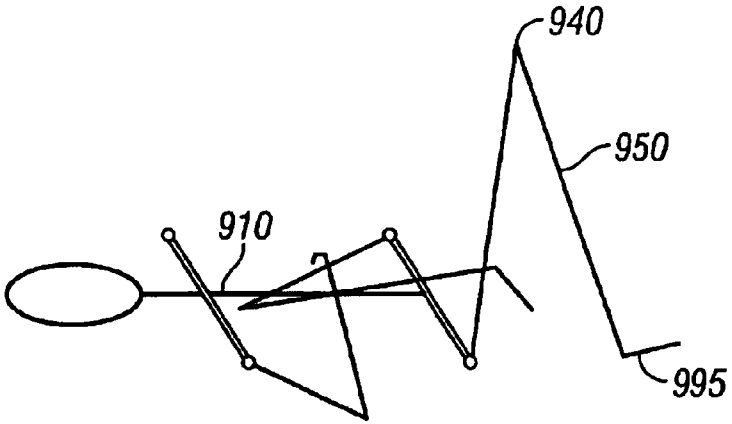
FIG. 9A and 9B are schematics of another variation of the internal hip rotation exercise protocol.
Figure 9A:
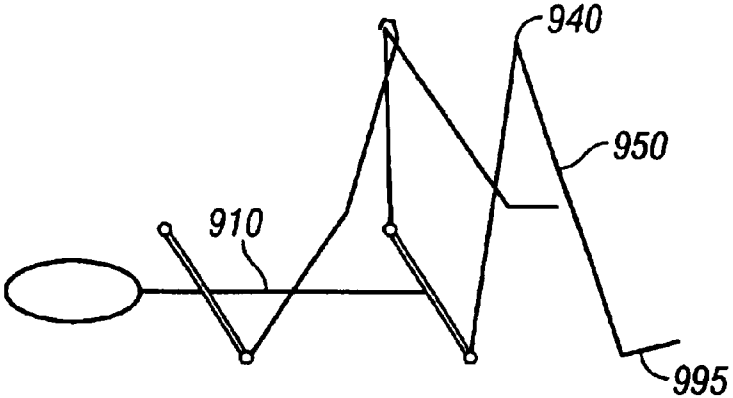

Another flexibility exercise is internal hip rotation as illustrated in FIGS. 7A and 7B. As shown in FIG. 7A, the exerciser 710 sits on a chair or other support platform and places the outer portion of the ankle 720 of the target leg 730 on the upper portion of the knee 740 of the support leg 750 as in the external hip rotation exercise. The exerciser 710 then exerts upward pressure on the target leg 730 with the hand 760 that is on the opposite side of the body as the target leg 730 so that the knee 770 of the target leg 730 is moved as far as possible toward the armpit 780 on the opposite side of the body, as shown in FIG. 7B. The internal hip rotation exercise stretches the external rotator muscles of the target hip 790 as well as the gluteus medius, gluteus maximus, and quadratus lumborum. In variations of this exercise, the exerciser 810 can be seated on the floor as illustrated in FIGS. 8A and 8B or the exerciser 910 can lie supine on the floor as illustrated in FIGS. 9A and 9B. If the exercise is done in a supine position, the knee 940 of the support leg 950 is bent so that the sole of the foot 995 of the support leg 950 is flat on the floor.

In another variation of the internal hip rotation exercise, the exerciser assumes the same seated, cross-legged starting position as shown in FIG. 7A. Then, in addition to exerting upward pressure on the target leg 730, as shown in FIG. 7B, the exerciser 710 also exerts inward pressure on the support leg 750 with the hand 765 that is on the opposite side of the body as the support leg 750 so that the knee 740 of the support leg 750 is moved as far as possible along a line parallel to a line connecting the hips, line H—H.

Figure 10B:
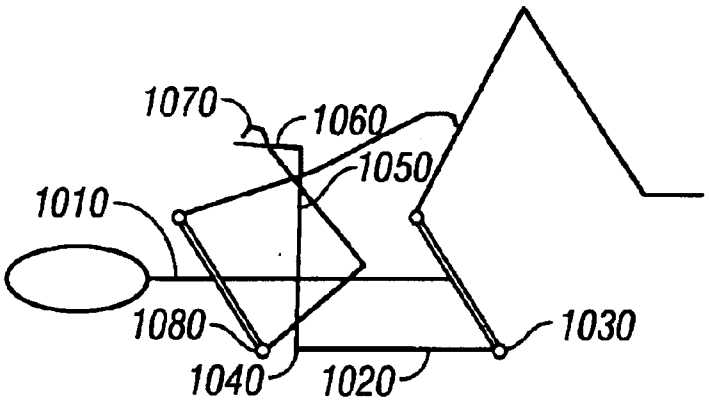
FIGS. 10A and 10B are schematics of a 'knee-to-armpit' exercise protocol.
Figure 10A:
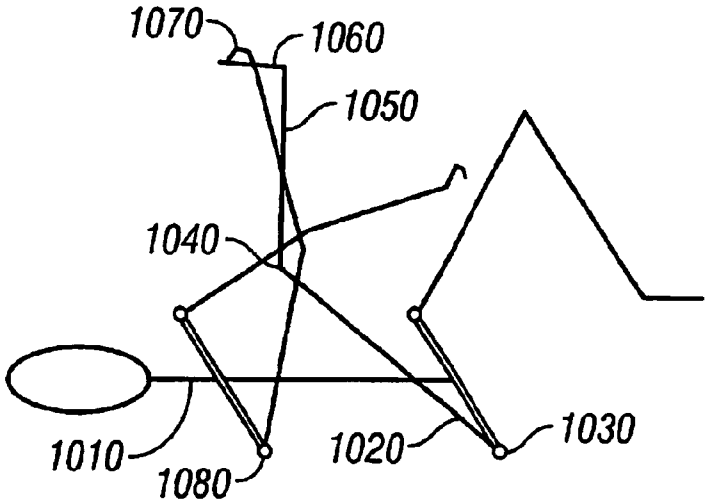
Figure 11B:
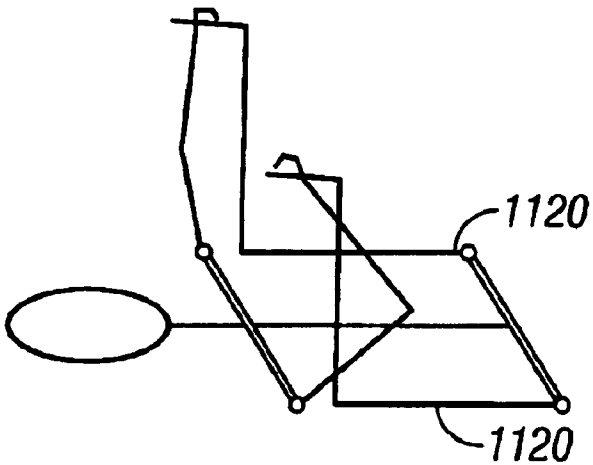
FIGS. 11A and 11B are schematics of a variation of the 'knee-to-armpit' exercise protocol.
Figure 11A:
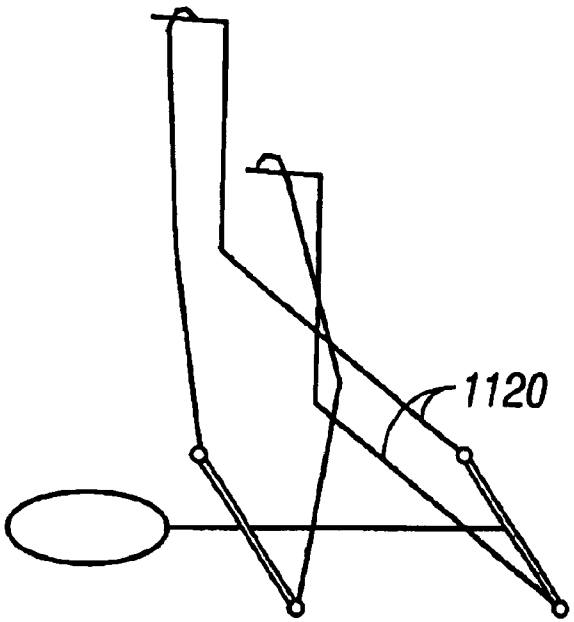

FIGS. 10A and 10B illustrate the knee-to-armpit exercise, another flexibility exercise. As shown in FIG. 10A, the exerciser 1010 lies in a supine position and bends the target leg 1020 at the hip 1030 and knee 1040 so that the lower leg 1050 of the target leg 1020 is generally perpendicular to the floor with the foot 1060 above the knee 1040. Grasping the outside of the foot 1060 of the target leg 1020 with the hand 1070 that is on the same side of the body as the target leg 1020, the exerciser 1010 pulls the target leg 1020 downward as far as possible toward the armpit 1080 that is on the same side of the body as the target leg 1020, as shown in FIG. 10B. The target muscles for the knee-to-armpit exercise are the hip extensors and the target joints are the hip and sacroiliac joints. In a variation of the knee-to-arrnpit exercise, both legs 1120 are target legs and are pulled downward simultaneously, as illustrated in FIGS. 11A and 11B.

Figure 12B:
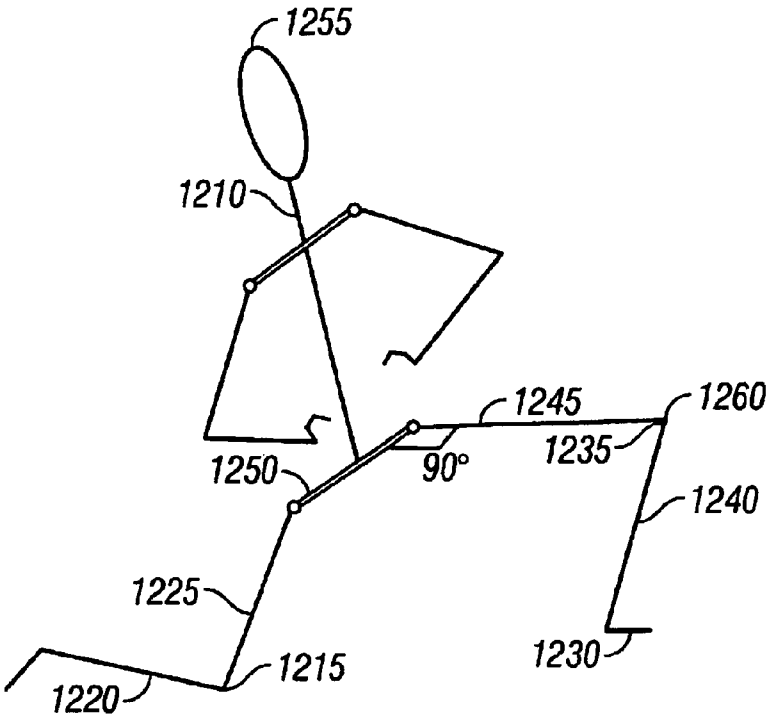
FIGS. 12A and 12B are schematics of a 'bow-and-arrow' exercise protocol.
Figure 12A:
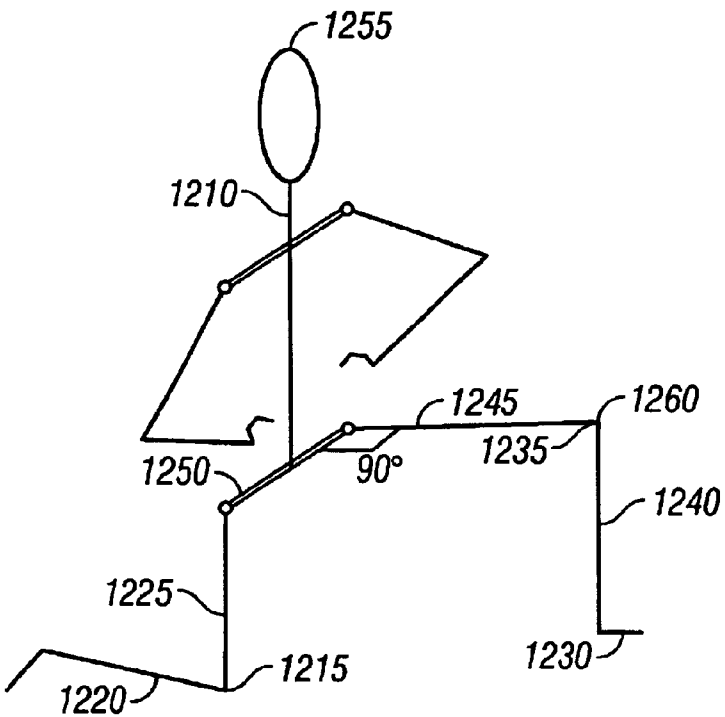

Another flexibility exercise is the 'bow-and-arrow', or hip flexor extension, as illustrated in FIGS. 12A and 12B. As shown in FIG. 12A, the exerciser 1210 places the knee 1215 of the target leg 1220 on the floor, maintaining the thigh 1225 of the target leg 1220 generally perpendicular to the floor, and places the sole of the foot 1230 of the non-target leg 1235 flat on the floor, maintaining the lower leg 1240 of the non-target leg 1235 generally perpendicular to the floor and the thigh 1245 of the non-target leg 1235 generally parallel to the floor. An approximately 90-degree angle is maintained between the hips 1250 and the thigh 1245 of the non-target leg 1235 and the head 1255 is maintained above the knee 1215 of the target leg 1220. The head 1255 and the knee 1215 of the target leg 1220 can be thought of as opposite ends of a bow and the knee 1260 of the non-target leg 1235 can be thought of as an arrow. The hips 1250 are then moved forward as far as possible in the direction of the knee 1260 of the non-target leg 1235, as shown in FIG. 12B. To achieve the maximum benefit from this exercise, the 90-degree angle between the hips 1250 and the thigh 1245 of the non-target leg 1235 should be maintained and the head 1255 should not move forward but should remain above the knee 1215 of the target leg 1220. The target muscles for the bow-and-arrow exercise are the psoas and the quadriceps and the target joints are the hip joint and lumbar spine.

Figure 13B:
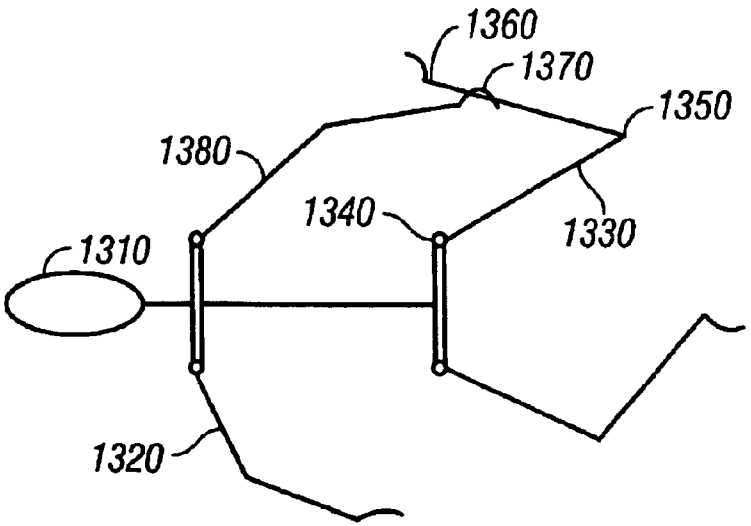
FIGS. 13A and 13B are schematics of a variation of the 'bow-and-arrow' exercise protocol.
Figure 13A:
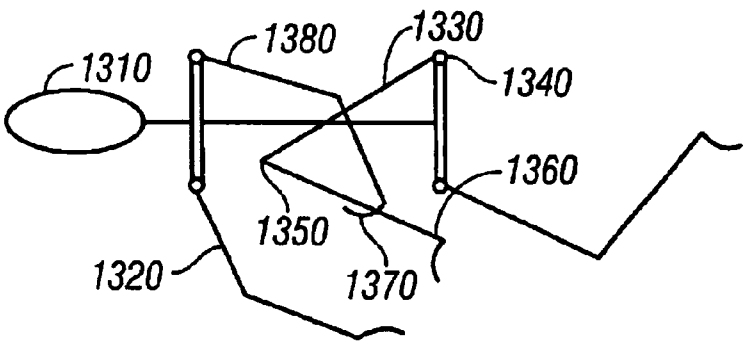

In a variation of the bow-and-arrow exercise, shown in FIGS. 13A and 13B, the exerciser 1310 lies on one side and places the arm 1320 that is in contact with the floor on the front side of the body, as shown in FIG. 13A. The leg 1330 that is not in contact with the floor (the target leg) is bent at the hip 1340 and knee 1350 so that the exerciser 1310 can grasp the ankle 1360 of the target leg 1330 with the hand 1370 of the arm 1380 that is not in contact with the floor. The exerciser 1310 then pulls the target leg 1330 toward the rear side of the body as far as possible, as shown in FIG. 13B.

Figure 14B:
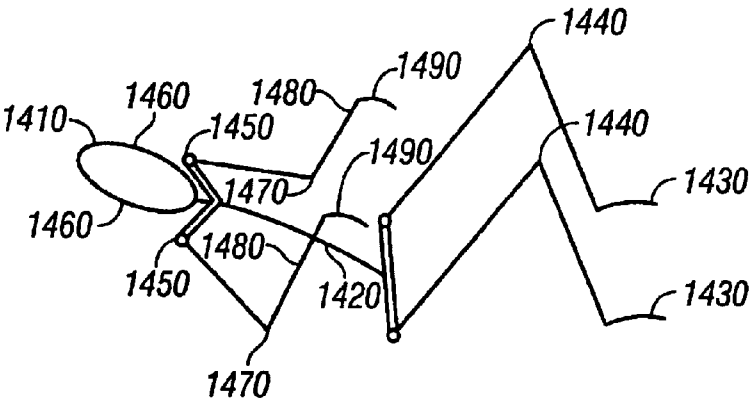
FIGS. 14A and 14B are schematics of a 'push down' exercise protocol.
Figure 14A:
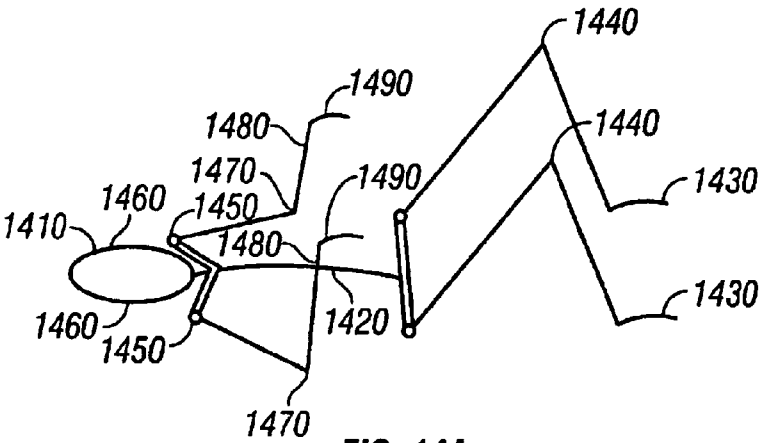

One of the strength exercises in the Back Pain/Back Health Protocol, the push down, is illustrated in FIGS. 14A and 14B. In the starting position, shown in FIG. 14A, the exerciser 1410 lies on the back 1420, places the soles of both feet 1430 flat on the floor, bends both knees 1440 to an approximately 45-degree angle, moves the shoulders 1450 upward toward the ears 1460, maintains an approximately three to four inch space between the elbows 1470 and the torso, maintains the forearms 1480 perpendicular to the floor, and relaxes the wrists 1490. The exerciser 1410 then lifts the shoulders 1450 and back 1420 as far as possible so that the elbows 1470 are the only part of the upper body in contact with the floor, as shown in FIG. 14B. This position is maintained for approximately one to two seconds. The target muscles for the push down are the rear deltoids, the rhomboids, and the five rotator cuff muscles.

Figure 15B:
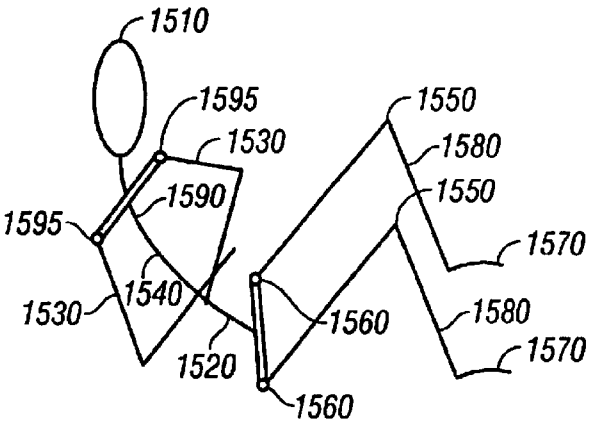
FIGS. 15A, 15B, and 15C are schematics of a 'three way abdominal crunch' exercise protocol.
Figure 15C:
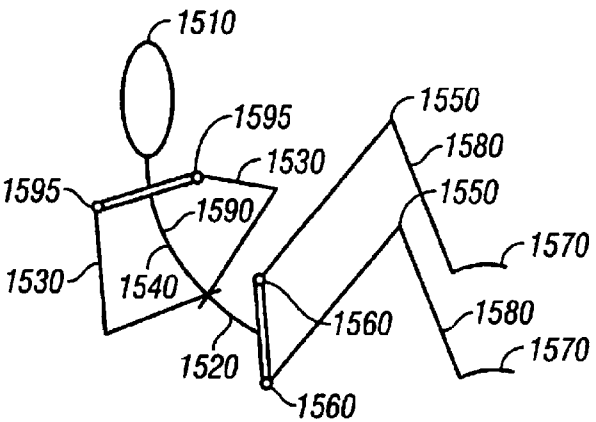
Figure 15A:
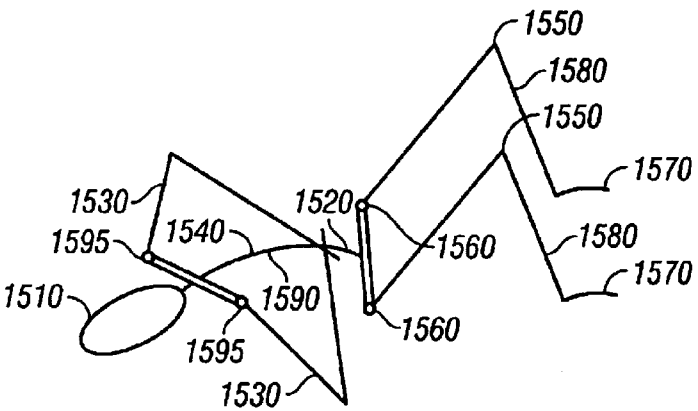

FIGS. 15A, 15B, and 15C illustrate the three-way abdominal crunch, another of the strength exercises. In the starting position of this exercise, shown in FIG. 15A, the exerciser 1510 lies on the back 1520, folds the arms 1530 across the chest 1540, and lifts the knees 1550 into a position higher than the hips 1560. The soles of the feet 1570 can be placed flat on the floor as shown in FIG. 15A or the lower legs 1580 can be placed on a supporting surface. The exercise is done in three steps. In the first step, shown in FIG. 15B, the exerciser 1510 flexes the torso 1590 toward the knees 1550, maintains that position for approximately one to two seconds, and returns to the starting position. In the second step, shown in FIG. 15C, the exerciser 1510 flexes the torso 1590 toward the knees 1550, lifts one hip 1560 upward and toward the armpit 1595 on the same side of the body as the lifted hip 1560, maintains that position for approximately one to two seconds, and returns to the starting position. The third step is identical to the second except that the opposite hip 1560 is lifted. The target muscles for the abdominal crunch are the quadratus lumborum, internal oblique, rectus, and transverse abdominus. In a variation, the abdominal crunch can be performed on an inclined or declined surface.

Figure 16B:
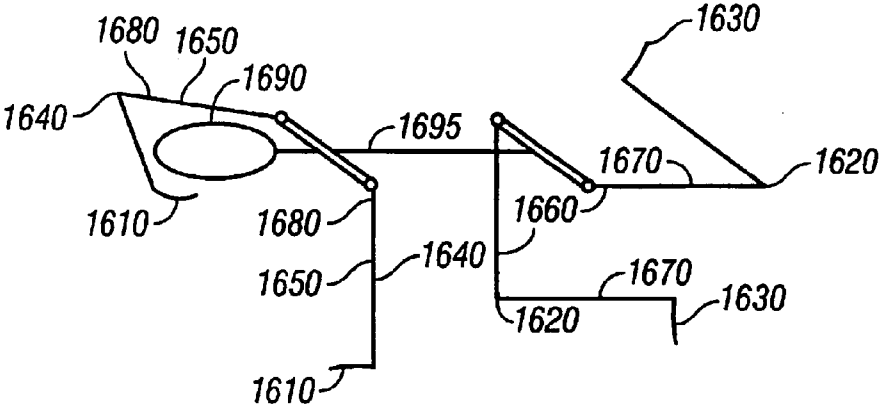
FIGS. 16A, 16B, and 16C are schematics of a 'kneeling arm and leg raise' exercise protocol and variations thereof.
Figure 16C:
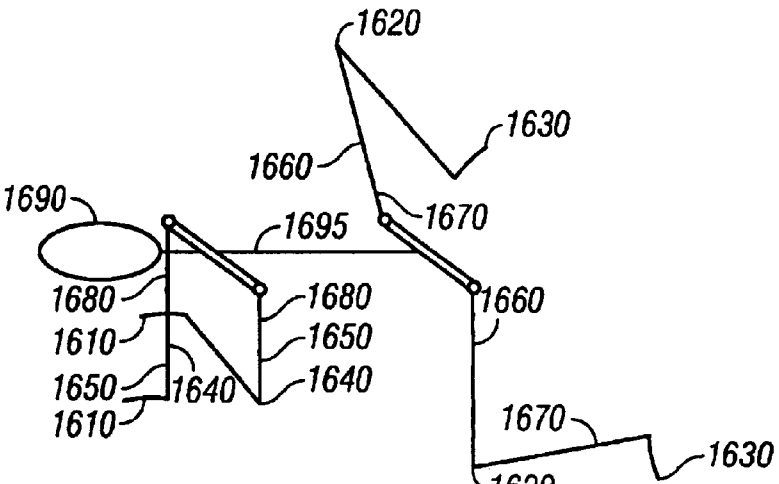
Figure 16A:
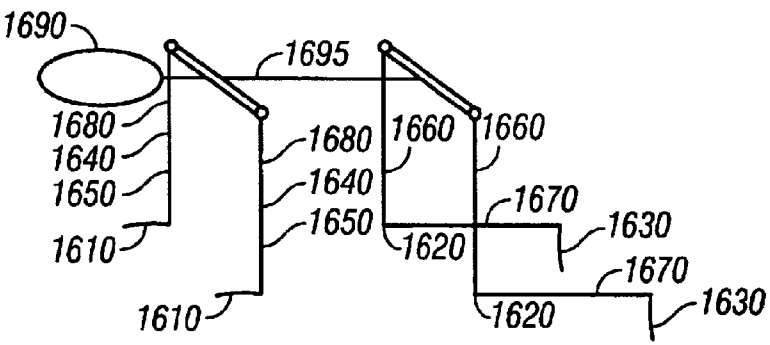
Figure 17B:
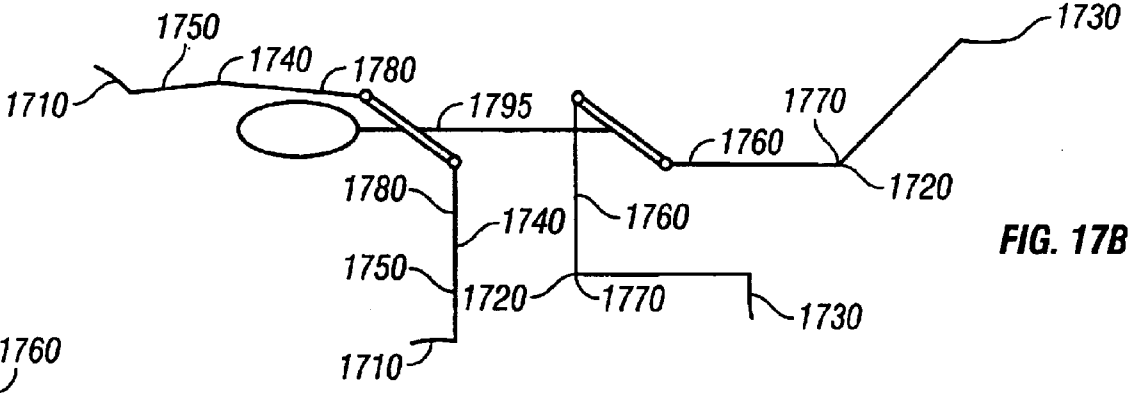
FIGS. 17A, 17B, and 17C are schematics of other variations of the 'kneeling arm and leg raise' exercise protocol.
Figure 17C:
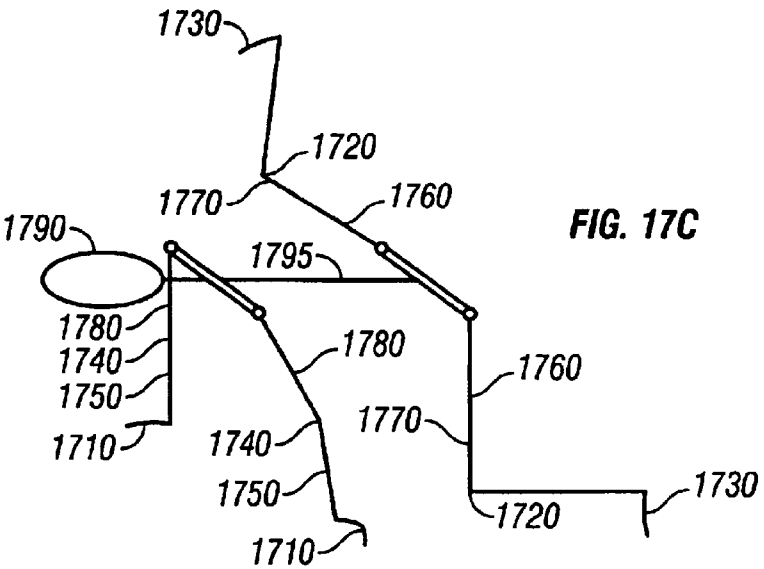
Figure 17A:
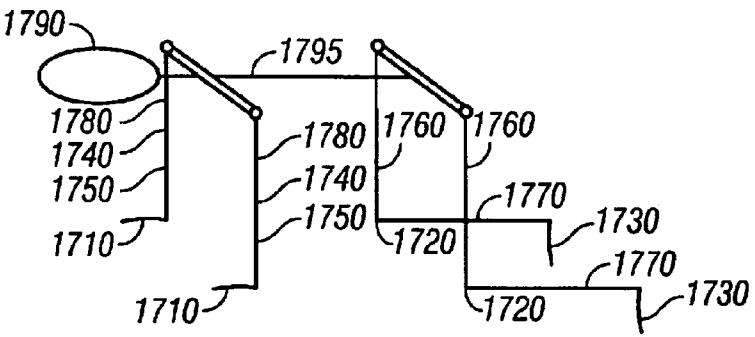

The kneeling arm and leg raise is another strength exercise. Several variations of this exercise are possible but the starting position for all the variations, shown in FIGS. 16A and 17A, is an all-fours position in which the hands 1610 and 1710, knees 1620 and 1720, and toes 1630 and 1730 are in contact with the floor, the elbows 1640 and 1740 are straight, and the arms 1650 and 1750 and thighs 1660 and 1760 are generally perpendicular to the floor. In one variation, illustrated in FIG. 16B, one leg 1670 is raised upward while maintaining its bent position so that the thigh 1660 is approximately parallel to the floor. Simultaneously, the bilaterally opposite arm 1650 is raised upward with the elbow 1640 at an approximately 90 degree angle and with the upper arm 1680 in a position near the ear 1690. This position is maintained for approximately one to two seconds. Another variation, illustrated in FIG. 17B, is similar to the first except that the raised arm 1750 and leg 1770 are not bent but are, instead, extended forward and backward, respectively, as far as possible. In another variation, illustrated in FIG. 17C, the raised arm 1750 and leg 1770 are straightened but, instead of being extended forward and backward, are extended sideward at approximately 90 degree angles to the torso 1795. Another variation, shown in FIG. 16C, allows the exerciser to decrease the angles to which the arms 1650 and legs 1670 are extended in order to make the exercise easier. Another technique to decrease the difficulty of the exercise is to lift only a leg 1670 or 1770 and not lift an arm 1650 or 1750 simultaneously. The target muscles for all the variations of the kneeling arm and leg raise are the hamstrings, gluteus medius, gluteus maximus, spinal erectors, quadratus lumborum, rear deltoid, trapezium, and rhomboids. The target joints are the sacroiliac, lumbar spine, thoracic spine, and cervical spine.

The descriptions of the alpha posture, the breathing reset method, and the exercises used in the Back Pain/Back Health Protocol are intended to convey the general principles used in those techniques. Those of skill in the art will recognize that variations in these methods will not diminish the effectiveness or uniqueness of the Back Pain/Back Health Protocol.

What is claimed is:

1. A method of preventing and relieving back muscle spasms comprising:

(a) performing an exercise protocol;

(b) maintaining an alpha posture to the extent possible during the performance of said exercise protocol; and (c) performing a breathing reset technique during the performance of said exercise protocol;

wherein the breathing reset technique comprises:

(i) assuming an alpha posture to the extent possible; and (ii) preferentially using the abdominal-based rather than thoracic based muscles for inhalation and exhalation;

(iii) whereby, by assuming the alpha posture, the volume of abdominal space is maximized and the use of abdominal-based breathing encouraged.

2. A method of preventing and relieving back muscle spasms comprising:

performing an exercise protocol;

maintaining an alpha posture to the extent possible during the performance of said exercise protocol; and performing a breathing reset technique during the performance of said exercise protocol;

wherein the exercise protocol is selected from a group consisting of;

(a) an external hip rotation exercise protocol;

(b) an internal hip rotation exercise protocol;

(c) a knee-to-armpit exercise protocol;

(d) a bow-and-arrow exercise protocol;

(e) a push down exercise protocol;

(f) a three-way abdominal crunch exercise protocol; and (g) a kneeling arm and leg raise exercise protocol.

3. A method of relieving and preventing back muscle spasms comprising:

performing an exercise protocol;

maintaining an alpha posture to the extent possible during the performance of said exercise protocol; and performing a breathing reset technique during the performance of said exercise protocol;

wherein maintaining the alpha posture comprises:

(a) maintaining the shoulders in a substantially straight line at generally right angles to the sides of the head;

(b) maintaining the cervical spine generally perpendicular to a line connecting the shoulders;

(c) maintaining the head directly above the line connecting the shoulders;

(d) maintaining the head generally equidistant between the shoulders;

(e) maintaining the shoulders generally equally in shoulder depression;

(f) maintaining a slight posterior curvature in the thoracic spine;

(g) maintaining a slight anterior curvature in the lumbar spine;

(h) rotating the pelvis to the posterior; and (i) maintaining the knees in a locked position.

4. The method of claim 1 wherein the breathing reset technique further comprises:

(iv) forming a mental image in which the body is generally hollow except for a target muscle-joint complex; and (v) while performing an exercise protocol focused on said target muscle-joint complex, imagining an exhaled breath passing from the top of the head, through said target muscle-joint complex, and out of the body.

5. The method of claim 4 further comprising:

(vi) while continuing said exercise, taking approximately two to three normal breaths.

6. The method of claim 5 wherein steps (v) and (vi) are repeated between two and four times.

7. A breathing reset technique comprising:

(a) preferentially using the abdominal-based rather than thoracic-based muscles for inhalation and exhalation;

(b) forming a mental image in which the body is generally hollow except for a target muscle-joint complex; and (c) while performing an exercise protocol focused on said target muscle-joint complex, imagining an exhaled breath passing from the top of the head, through said target muscle-joint complex, and out of the body.

8. The technique of claim 7 further comprising:

(d) while continuing said exercise, taking approximately two to three normal breaths.

9. The technique of claim 8 wherein steps (c) and (d) are repeated between two and four times.

10. The technique of claim 7 wherein the exercise protocol is selected from a group consisting of:

(a) an external hip rotation exercise protocol;

(b) an internal hip rotation exercise protocol;

(c) a knee-to-armpit exercise protocol;

(d) bow-and-arrow exercise protocol;

(e) a push down exercise protocol;

(f) a three-way abdominal crunch exercise protocol; and (g) a kneeling arm and leg raise exercise protocol.

11. The technique of claim 7 wherein the exercise protocol comprises:

(a) an external hip rotation exercise protocol;

(b) an internal hip rotation exercise protocol;

(c) a knee-to-armpit exercise protocol; and (d) a bow-and-arrow exercise protocol.

12. The technique of claim 7 wherein the exercise protocol comprises:

(a) a push down exercise protocol;

(b) a three-way abdominal crunch exercise protocol; and (c) a kneeling arm and leg raise exercise protocol.

13. The technique of claim 7 further comprising:

(d) assuming an alpha posture to the extent possible.

14. A back pain/back health protocol comprising:

performing an exercise protocol; and maintaining an alpha posture to the extent possible during the performance of said exercise protocol;

wherein the exercise protocol is selected from a group consisting of:

(a) an external hip rotation exercise protocol;

(b) an internal hip rotation exercise protocol;

(c) a knee-to-armpit exercise protocol; (d) a bow-and-arrow exercise protocol; (e) a push down exercise protocol; (f) a three-way abdominal crunch exercise protocol; and (g) a kneeling arm and leg raise exercise protocol.

15. A back pain/back health protocol comprising:

performing an exercise protocol; and maintaining an alpha posture to the extent possible during the performance of said exercise protocol;

wherein maintaining the alpha posture comprises:

(a) maintaining the shoulders in a substantially straight line at generally right angles to the sides of the head;

(b) maintaining the cervical spine generally perpendicular to a line connecting the shoulders;

(c) maintaining the head directly above the line connecting the shoulders;

(d) maintaining the head generally equidistant between the shoulders;

(e) maintaining the shoulders generally equally in shoulder depression;

(f) maintaining a slight posterior curvature in the thoracic spine;

(g) maintaining a slight anterior curvature in the lumbar spine;

(h) rotating the pelvis to the posterior; and (i) maintaining the knees in a locked position.

16. A back pain/back health protocol comprising:

performing an exercise protocol; and maintaining an alpha posture to the extent possible during the performance of said exercise protocol;

wherein the exercise protocol is selected from a group consisting of:

(a) an external hip rotation exercise protocol;

(b) an internal hip rotation exercise protocol;

(a) a knee-to-armpit exercise protocol; and (b) a bow-and-arrow exercise protocol.

17. A back pain/back health protocol comprising:

performing an exercise protocol; and maintaining an alpha posture to the extent possible during the performance of said exercise protocol;

wherein the exercise protocol is selected from a group consisting of:

(a) a push down exercise protocol;

(b) a three-way abdominal crunch exercise protocol; and (c) a kneeling arm and leg raise exercise protocol.

18. The protocol of claim 16 wherein the external hip rotation exercise protocol comprises:

(a) placing the outer portion of an ankle of a target leg on the upper portion of a knee of a support leg; and (b) exerting downward pressure on the target leg with the hand that is on the same side of the body as the target leg.

19. The protocol of claim 16 wherein the internal hip rotation exercise protocol comprises:

(a) placing the outer portion of an ankle of a target leg on the upper portion of a knee of a support leg; and (b) exerting upward pressure on the target leg with the hand that is on the opposite side of the body as the target leg so that the knee of the target leg is moved toward the armpit on the opposite side of the body.

20. The protocol of claim 16 wherein the knee-to-armpit exercise protocol comprises:

(a) lying on the back;

(b) bending a target leg at the hip and knee so that the lower leg of the target leg is generally perpendicular to the floor with the foot above the knee;

(c) grasping the outside of the foot of the target leg with the hand that is on the same side of the body as the target leg; and (d) using the hand that is on the same side of the body as the target leg to pull the target leg downward toward the armpit that is on the same side of the body as the target leg.

21. The protocol of claim 16 wherein the bow-and-arrow exercise protocol comprises:

(a) placing the knee of a target leg on the floor;

(b) maintaining the thigh of the target leg generally perpendicular to the floor;

(c) placing the sole of the foot of the non-target leg generally flat on the floor;

(d) maintaining the lower leg of the non-target leg generally perpendicular to the floor;

(e) maintaining the thigh of the non-target leg generally parallel to the floor;

(f) maintaining an approximately 90-degree angle between the hips and the thigh of the non-target leg;

(g) maintaining the head above the knee of the target leg; and (h) moving the hips forward as much as possible.

22. The protocol of claim 17 wherein the push down exercise protocol comprises:

(a) lying on the back;

(b) placing the soles of both feet generally flat on the floor;

(c) bending both knees to an approximately 45-degree angle;

(d) moving the shoulders as close as possible to the ears;

(e) maintaining an approximately three to four inch space between the elbows and the torso;

(f) maintaining the forearms generally perpendicular to the floor;

(g) relaxing the wrists;

(h) lifting the shoulders and back so that the elbows are the only part of the upper body in contact with the floor; and (i) maintaining the position described in step (h) for approximately one to two seconds.

23. The protocol of claim 17 wherein the three way abdominal crunch exercise protocol comprises:

(a) lying on the back;

(b) lifting the knees into a position higher than the hips;

(c) folding the arms across the chest;

(d) flexing the torso toward the knees; and (e) maintaining the position described in step (d) for approximately one to two seconds.

24. The protocol of claim 17 wherein the kneeling arm and leg raise exercise protocol comprises:

(a) placing the hands, knees, and toes in contact with the floor;

(b) placing the elbows in a straight position;

(c) placing the arms and thighs generally perpendicular to the floor;

(d) raising a leg upward while maintaining its bent position so that the thigh is generally parallel to the floor; and (e) maintaining the position described in step (d) for approximately one to two seconds.

* * * * *

UNITED STATES PATENT AND TRADEMARK OFFICE

CERTIFICATE OF CORRECTION

PATENT NO. : 6,730,006 B1
DATED : May 4, 2004
INVENTOR(S) : Paul Patterson

It is certified that error appears in the above-identified patent and that said Letters Patent is hereby corrected as shown below:

Column 4,
Lines 53 and 61, replace "musclejoint" with -- muscle-joint --.

Column 10,
Line 13, replace "(c) a knee-to-armpit exercise protocol; (d) a bow-and-arrow exercis a push down exercise protocol; (f) a three-way abdominal crunch exercise protocol; and arm and leg raise exercise protocol." with the following:
-- (c) a knee-to-armpit exercise protocol;

(d) a bow-and-arrow exercise protocol;

(e) a push down exercise protocol;

(f) a three-way abdominal crunch exercise protocol; and --

Signed and Sealed this

Twentieth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,730,006 B1
DATED : May 4, 2004
INVENTOR(S) : Paul Patterson

It is certified that error appears in the above-identified patent and that said Letters Patent is hereby corrected as shown below:

Title page,
Item [*] Notice, "Subject to any disclaimer, the term of this patent is extended or adjusted under 35 U.S.C. 154 (b) by 0 days." should read -- Subject to any disclaimer, the term of this patent is extended or adjusted under 35 U.S.C. 154 (b) by 34 days. --

Signed and Sealed this

Nineteenth Day of October, 2004

JON W. DUDAS
*Director of the United States Patent and Trademark Office*